US009099034B2

(12) United States Patent
Choi et al.

(10) Patent No.: US 9,099,034 B2
(45) Date of Patent: Aug. 4, 2015

(54) ORGANIC LIGHT EMITTING DISPLAY AND METHOD OF DRIVING THE SAME

(75) Inventors: Yong-Seok Choi, Yongin (KR); Byung-Ki Chun, Yongin (KR); Jeong-Eun Kim, Yongin (KR); Jong-Woong Park, Yongin (KR); Joo-Hyung Lee, Yongin (KR)

(73) Assignee: Samsung Display Co., Ltd. (KR)

( * ) Notice: Subject to any disclaimer, the term of this patent is extended or adjusted under 35 U.S.C. 154(b) by 400 days.

(21) Appl. No.: 13/594,551

(22) Filed: Aug. 24, 2012

(65) Prior Publication Data

US 2013/0271502 A1 Oct. 17, 2013

(30) Foreign Application Priority Data

Apr. 17, 2012 (KR) ..... 10-2012-0039748

(51) Int. Cl.
*G09G 3/32* (2006.01)
*G09G 5/10* (2006.01)

(52) U.S. Cl.
CPC ..... *G09G 3/3208* (2013.01); *G09G 2320/0223* (2013.01); *G09G 2320/0271* (2013.01)

(58) Field of Classification Search
CPC ..... G09G 3/32; G09G 5/10; G09G 3/3208
See application file for complete search history.

(56) References Cited

U.S. PATENT DOCUMENTS

| | | | | |
|---|---|---|---|---|
| 7,965,265 | B2 * | 6/2011 | Lee | 345/77 |
| 7,978,159 | B2 | 7/2011 | Kim et al. | |
| 2011/0181786 | A1 * | 7/2011 | Yamazaki et al. | 348/671 |
| 2011/0261039 | A1 * | 10/2011 | Kubota | 345/207 |

FOREIGN PATENT DOCUMENTS

| | | |
|---|---|---|
| KR | 10-2008-0002141 | 1/2008 |
| KR | 10-2008-0023933 | 3/2008 |
| KR | 10-2008-0057434 | 6/2008 |

* cited by examiner

*Primary Examiner* — Andrew Sasinowski
(74) *Attorney, Agent, or Firm* — Knobbe Martens Olson & Bear LLP

(57) ABSTRACT

An organic light emitting display capable of improving display quality is disclosed. The organic light emitting display includes pixels positioned at intersections of scan lines and data lines, a data driver for generating data signals to be supplied to the data lines using second data, and a data processing unit for generating a second data whose bit value is changed in consideration of brightness distribution of first data items supplied from the outside.

22 Claims, 4 Drawing Sheets

| Third brightness distribution value | First brightness distribution value | Second brightness distribution value | First calculated value | Second calculated value |
|---|---|---|---|---|
| 0.1 | 0.1 | 0.8 | 0.11 | 0.13 |
| 0.2 | 0.1 | 0.7 | 0.25 | 0.14 |
| 0.3 | 0.1 | 0.6 | 0.43 | 0.17 |
| 0.4 | 0.1 | 0.5 | 0.67 | 0.2 |
| 0.5 | 0.1 | 0.4 | 1 | 0.25 |
| 0.6 | 0.1 | 0.3 | 1.5 | 0.33 |
| 0.65 | 0.05 | 0.3 | 1.86 | 0.17 |
| 0.7 | 0.1 | 0.2 | 2.33 | 0.5 |
| 0.75 | 0.05 | 0.2 | 3 | 0.25 |
| 0.8 | 0.1 | 0.1 | 4 | 1 |

| Third brightness distribution value | First brightness distribution value | Second brightness distribution value | First calculated value | Second calculated value |
|---|---|---|---|---|
| 0.1 | 0.8 | 0.1 | 0.11 | 8 |
| 0.2 | 0.7 | 0.1 | 0.25 | 7 |
| 0.3 | 0.6 | 0.1 | 0.43 | 6 |
| 0.4 | 0.5 | 0.1 | 0.67 | 5 |
| 0.5 | 0.4 | 0.1 | 1 | 4 |
| 0.6 | 0.3 | 0.1 | 1.5 | 3 |
| 0.65 | 0.3 | 0.05 | 1.86 | 6 |
| 0.7 | 0.2 | 0.1 | 2.33 | 2 |
| 0.75 | 0.2 | 0.05 | 3 | 4 |
| 0.8 | 0.1 | 0.1 | 4 | 1 |

ORGANIC LIGHT EMITTING DISPLAY AND METHOD OF DRIVING THE SAME

CROSS-REFERENCE TO RELATED APPLICATIONS

This application claims priority to and the benefit of Korean Patent Application No. 10-2012-0039748, filed on Apr. 17, 2012, in the Korean Intellectual Property Office, the entire content of which is incorporated herein by reference.

BACKGROUND

1. Field

The present disclosure relates to an organic light emitting display and a method of driving the same, and more particularly, to an organic light emitting display capable of improving display quality and a method of driving the same.

2. Description of the Related Technology

Recently, various flat panel displays (FPD) capable of reducing weight and volume, which were some disadvantages associated with cathode ray tubes (CRT), have been developed. The FPDs include liquid crystal displays (LCD), field emission displays (FED), plasma display panels (PDP), and organic light emitting displays.

Among the FPDs, the organic light emitting displays display images using organic light emitting diodes (OLED) that generate light by re-combination of electrons and holes. The organic light emitting display has a high response speed and is driven with low power consumption. A common organic light emitting display supplies currents corresponding to data signals to organic light emitting diodes (OLED) using driving transistors formed in pixels so that light is emitted by the OLEDs.

Generally, pixels charge voltages corresponding to the data signals in at least one capacitor and supply the currents corresponding to the charged voltages from a first power source via the OLEDs using the driving transistors to display an image. However, the organic light emitting display displays an image using the currents so that a non-uniform image is displayed due to the brightness components of the pixels displayed on a panel, that is, a loading effect.

When the number of pixels that realize high gray scales (bright gray scales) is large, the pixels that realize the high gray scales become brighter and the pixels that realize low gray scales become darker. In addition, when the number of pixels that realize the low gray scales (dark gray scales) is large, the pixels that realize the low gray scales become brighter.

SUMMARY OF CERTAIN INVENTIVE ASPECTS

Accordingly, the present invention has been made to provide an organic light emitting display capable of improving display quality and a method of driving the same.

In order to achieve the foregoing and/or other aspects of the present invention, there is provided an organic light emitting display, including pixels positioned at intersections of scan lines and data lines, a data driver for generating data signals to be supplied to the data lines using second data, and a data processing unit for generating the second data whose bit value is changed in consideration of brightness distribution of first data items supplied from the outside.

The data processing unit includes a brightness extracting unit for extracting a brightness value from the first data items, an estimating unit for generating a first calculated value that represents a ratio of low gray scales from the brightness value, a second calculated value that represents a ratio of high gray scales, and a compensating value including the brightness distribution information, and a compensating unit for generating the second data using the first calculated value, the second calculated value, and the compensating value. The brightness extracting unit extracts the brightness value from each pixel.

The estimating unit increases a first brightness value when the brightness value is no less than a first threshold value that represents a reference point of high gray scales, increases a third brightness value when the brightness value is no more than a second threshold value that represents a reference point of low gray scales, and increases a second brightness value when the brightness value is positioned between the first threshold value and the second threshold value and divides the first brightness value, the second brightness value, and the third brightness value by the number of entire pixels to generate a first brightness distribution value, a second brightness distribution value, and a third brightness distribution value. The estimating unit divides the third brightness distribution value by a value obtained by adding the first brightness distribution value and the second brightness distribution value to generate the first calculated value and divides the first brightness distribution value by the second brightness distribution value to generate the second calculated value. The estimating unit compares the first calculated value with a plurality of different reference values to generate the compensating value. The compensating unit changes a bit of the first data so that brightness is reduced to generate the second data when the first calculated value is larger than the second calculated value. The compensating unit generates the second data so that the brightness is reduced as the compensating value increases. The compensating unit changes the first data so that brightness of low gray scales is increased and that brightness of high gray scales is reduced to generate the second data when the second calculated value is larger than the first calculated value. The compensating unit controls a brightness increase value of the low gray scales and a brightness reduction value of the high gray scales in inverse proportion to the compensating value.

The organic light emitting display further includes a frame memory for storing the first data items and for supplying the stored first data items to the brightness extracting unit and the compensating unit. The organic light emitting display further includes a frame memory for storing the first data items and for supplying the stored first data items to the compensating unit. The organic light emitting display further includes a frame memory coupled to the compensating unit to store the second data items and to supply the stored second data items.

There is provided a method of driving an organic light emitting display, including extracting a brightness value from first data, generating a first calculated value that represents a ratio of low gray scales from the brightness value, generating a second calculated value that represents a ratio of high gray scales from the brightness value, generating a compensating value including brightness distribution information using the first calculated value, and changing a bit of first data supplied from the outside using the first calculated value, the second calculated value, and the compensating value to generate second data.

In the organic light emitting display according to the embodiment of the present invention and the method of driving the same, the data items are changed to correspond to the brightness distribution of the pixels to display an image of desired brightness. In particular, according to the present invention, since the data items are changed in consideration of the brightness distribution of the high gray scales, the intermediate gray scales, and the low gray scales, it is possible to display an image with higher quality.

BRIEF DESCRIPTION OF THE DRAWINGS

The accompanying drawings, together with the specification, illustrate certain embodiments of the present invention, and, together with the description, serve to explain the principles of the present invention.

DETAILED DESCRIPTION OF CERTAIN INVENTIVE EMBODIMENTS

Figure 1:
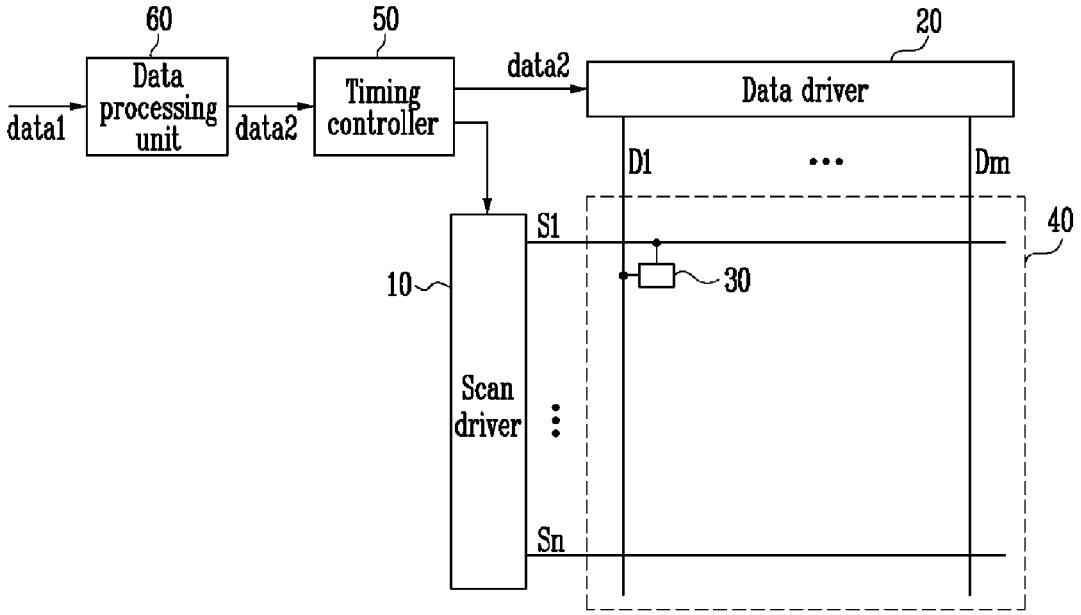
FIG. 1 is a view illustrating an organic light emitting display according to an embodiment of the present invention.

Hereinafter, certain embodiments according to the present invention will be described with reference to the accompanying drawings. When a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals generally refer to like elements throughout.

Hereinafter, an organic light emitting display according to the present invention and a method of driving the same will be described in detail as follows with reference to FIGS. 1 to 7 in which certain embodiments by which those who skilled in the art may easily perform the present invention are included.

FIG. 1 is a view illustrating an organic light emitting display according to an embodiment of the present invention.

Referring to FIG. 1, the organic light emitting display according to an embodiment of the present invention includes a pixel unit 40 including pixels 30 positioned in a region defined by scan lines S1 to Sn and data lines D1 to Dm, a scan driver 10 for driving the scan lines S1 to Sn, a data driver 20 for driving the data lines D1 to Dm, a timing controller 50 for controlling the scan driver 10 and the data driver 20, and a data processing unit 60 for generating second data data2 using first data data1 supplied from the outside.

The pixels 30 are positioned at the intersections of the scan lines S1 to Sn and the data lines D1 to Dm. The pixels 30 are selected when scan signals are supplied to store voltages corresponding to data signals and to generate light components with predetermined brightness components to correspond to the stored voltages.

The scan driver 10 supplies the scan signals to the scan lines S1 to Sn. For example, the scan driver 10 may sequentially supply the scan signals to the scan lines S1 to Sn. In this case, the pixels 30 are sequentially selected in units of horizontal lines.

The data driver 20 supplies the data signals to the data lines D1 to Dm in synchronization with the scan signals. Then, the data signals are supplied to the pixels 30 selected by the scan signals.

The timing controller 50 supplies control signals (not shown) for controlling the scan driver 10 and the data drier 20. In addition, the timing controller 50 transmits the second data data2 supplied from the data processing unit 60 to the data driver 20.

The data processing unit 60 generates the second data data2 using the first data data1. The data processing unit 60 generates the second data data2 so that an image with desired brightness may be displayed regardless of loading effect, that is, regardless of the brightness distribution of the first data data1 of one frame. This is described further below.

Figure 2:
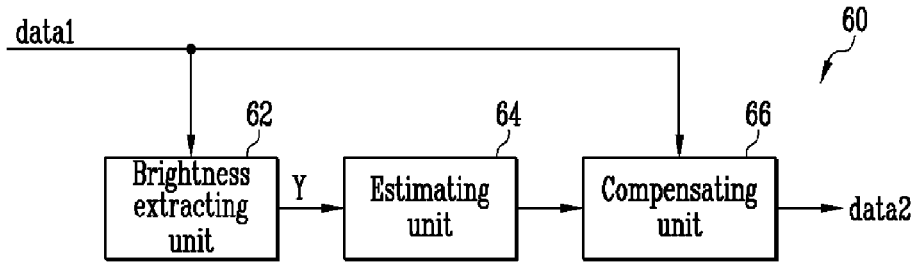
FIG. 2 is a view illustrating a first embodiment of the data processing unit of FIG. 1.

FIG. 2 is a view illustrating a first embodiment of the data processing unit of FIG. 1.

Referring to FIG. 2, the data processing unit 60 according to the first embodiment of the present invention includes a brightness extracting unit 62, an estimating unit 64, and a compensating unit 66.

The brightness extracting unit 62 extracts a brightness value Y using the first data data1 input from the outside and supplies the extracted brightness value Y to the estimating unit 64. The brightness extracting unit 62 extracts the brightness value Y of each pixel using the first data data1 and supplies the brightness value Y of each pixel to the estimating unit 64.

The estimating unit 64 generates a first calculated value that represents the ratio of low gray scales to intermediate gray scales and high gray scales and a second calculated value that represents the ratio of the high gray scales to the intermediate gray scales. In addition, the estimating unit 64 generates a compensating value that represents the strength of the loading effect to correspond to the first calculated value and the second calculated value. The detailed operation processes of the estimating unit 64 is described below.

The compensating unit 66 changes the first data data1 to generate the second data data2. The compensating unit 66 generates the second data data2 so that an image with desired brightness may be displayed regardless of the loading effect using the first calculated value, the second calculated value, and the compensating value. The detailed operation processes of the compensating unit 66 are described below in connection with the estimating unit 64.

Figures 3, 4A:
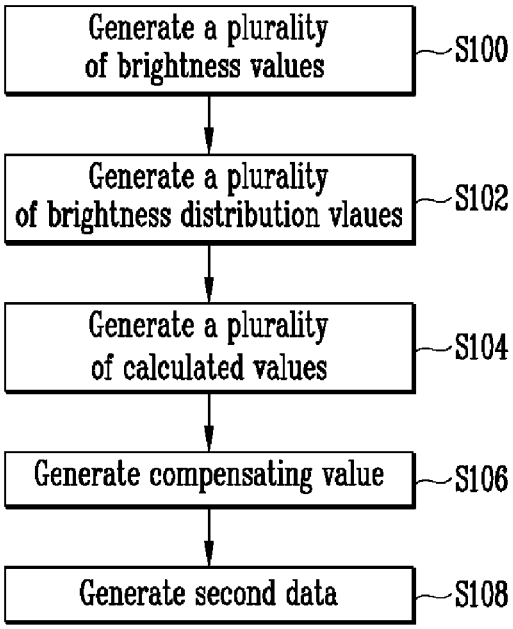
FIG. 3 is a view illustrating an embodiment of the operation processes of the estimating unit and the compensating unit of FIG. 2.
FIGS. 4A and 4B are views illustrating an example of a first calculated value and a second calculated value.

FIG. 3 is a view illustrating an embodiment of the operation processes of the estimating unit and the compensating unit of FIG. 2.

Referring to FIG. 3, first, the estimating unit 64 generates a plurality of brightness values using the brightness value Y supplied from the brightness extracting unit 62 (S100). A plurality of different threshold values, for example, a first threshold value and a second threshold value may be previously stored. The first threshold value represents the reference point of the high gray scales so that a first brightness value increases when the brightness value Y is equal to or larger than the first threshold value. The second threshold value represents the reference point of the low gray scales so that a third brightness value increases when the brightness value Y is equal to or lower than the second threshold value. When the brightness value Y is positioned between the first threshold value and the second threshold value, a second brightness value increases.

That is, in S100, the estimating unit 64 compares the previously stored first threshold value, second threshold value, and brightness value Y with each other to generate the first brightness value, the second brightness value, and the third brightness value to correspond to the comparison result. The first threshold value and the second threshold value are used as reference values for determining the high gray scales and the low gray scales and are experimentally determined in consideration of the inch and resolution of a panel.

After the first to third brightness values are generated, the estimating unit 64 divides the first brightness value, the second brightness value, and the third brightness value by the number of entire pixels 30 to generate a first brightness distribution value, a second brightness distribution value, and a third brightness distribution value (S120). When the first brightness value is divided by the number of entire pixels 30, the ratio of the high gray scales to the number of entire pixels 30 is generated as the first brightness distribution value. When the second brightness value and the third brightness value are divided by the number of entire pixels 30, the second brightness distribution value that represents the ratio of the intermediate gray scales to the number of entire pixels 30 and the third brightness distribution value that represents the ratio of the low gray scales to the number of entire pixels 30 are generated. When the first brightness distribution value, the second brightness distribution value, and the third brightness distribution value are added to each other, a calculated value is set as "1".

After the brightness distribution values are generated, the estimating unit 64 obtains the first calculated value and the second calculated value using EQUATIONS 1 and 2 (S104).

$$\text{first calculated value} = \frac{\text{third brightness distribution value}}{\text{first brightness distribution value} + \text{second brightness distribution value}} \quad \text{[EQUATION 1]}$$

$$\text{second calculated value} = \frac{\text{first brightness distribution value}}{\text{second brightness distribution value}} \quad \text{[EQUATION 2]}$$

The first calculated value generated by EQUATION 1 represents the ratio of the low gray scales to the high gray scales and the intermediate gray scales. The second calculated value generated by EQUATION 2 represents the ratio of the high gray scales to the intermediate gray scales.

Figures 4B, 5:
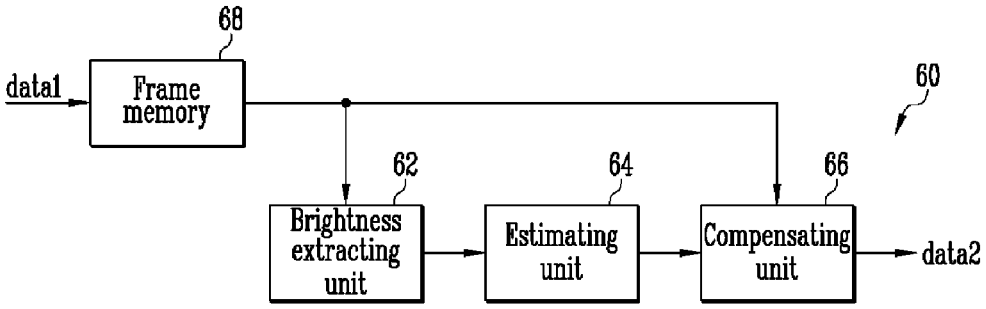
FIG. 5 is a view illustrating a second embodiment of the data processing unit of FIG. 1.

The first calculated value and the second calculated value may be calculated to correspond to the first to third brightness distribution values as illustrated in FIGS. 4A and 4B. In FIGS. 4A and 4B, for convenience sake, the first calculated value and the second calculated value are rounded off to two decimal places. However, the present invention is not limited to the above.

In S104, the estimating unit 64 that generates the first calculated value and the second calculated value compares the first calculated value with previously set reference values to generate a compensating value (S106). In the compensating value, brightness distribution information is displayed by a predetermined value. The estimating unit 64 compares the first calculated value with the previously set reference values to generate the compensating value that represents the compensating degree of the first data data1.

For example, the estimating unit 64 compares reference values with first calculated values to generate compensating values as illustrated in TABLE 1.

TABLE 1

| Comparison | | Result |
|---|---|---|
| | Reference value | Compensating value |
| First calculated value | 1 | 0 |
| | 1.5 | 1 |
| | 1.86 | 2 |
| | 2.33 | 3 |
| | 3 | 4 |
| | 4 | 5 |

Referring to TABLE 1, the reference values are set as 1, 1.5, 1.86, 2.33, 3, and 4. The estimating unit 64 compares the first calculated values with the first reference values to generate the compensating values as illustrated in FIG. 4A. For example, when the first calculated values are set as 0.11 and 0.67, the compensating value is set as 0. When the first calculated value is set as 2.33, the compensating value is set as 3. The reference values may be set to different values than those above, and are experimentally determined in consideration of the resolution and inch of the panel.

The first calculated value, the second calculated value, and the compensating value generated in S104 and S106 are supplied to the compensating unit 66. The compensating unit 66 then changes the bit of the first data data1 to generate the second data data2.

The compensating unit 66 compares the first calculated value and the second calculated value supplied from the estimating unit 64. When the first calculated value is larger than the second calculated value, an image is displayed in a region where the number of low gray scales is larger than the number of high gray scales. In this case, in order to prevent the brightness from increasing, the compensating unit 66 changes the bit of the first data data1 so that the brightness is reduced to generate the second data data2. The compensating unit 66 controls the change range of the bit to correspond to the compensating value. The compensating unit 66 generates the second data data2 so that the brightness is reduced as the compensating value increases. When the compensating value is 0, since a difference between the ratio of the high gray scales and the ratio of the low gray scales is not large, the compensating unit 66 may output the second data data2 without changing the bit of the first data data1.

When the second calculated value is larger than the first calculated value, an image is displayed in a region where the number of high gray scales is larger than the number of intermediate gray scales. The compensating unit 66 changes the bit of the first data data1 so that the brightness of the low gray scales is increased and that the brightness of the high gray scales is reduced to generate the second data data2. The compensating unit 66 controls the brightness increase value of the low gray scales and the brightness reduction value of the high gray scales in inverse proportion to the compensating value.

FIG. 5 is a view illustrating a second embodiment of the data processing unit of FIG. 1. In FIG. 5, the same elements as the elements of FIG. 2 are denoted by the same reference numerals and detailed description thereof will be omitted.

Referring to FIG. 5, the data processing unit 60 according to the second embodiment of the present invention further includes a frame memory 68 for storing the first data data1 and for supplying the stored first data data1 to the brightness extracting unit 62 and the compensating unit 66. The frame memory 68 stores the first data data1 of one frame and outputs the stored first data data1. When the frame memory 68 is added, since the first data data1 is not supplied to the brightness extracting unit 62 and the compensating unit 66 in real time, stability is improved.

Figure 6:
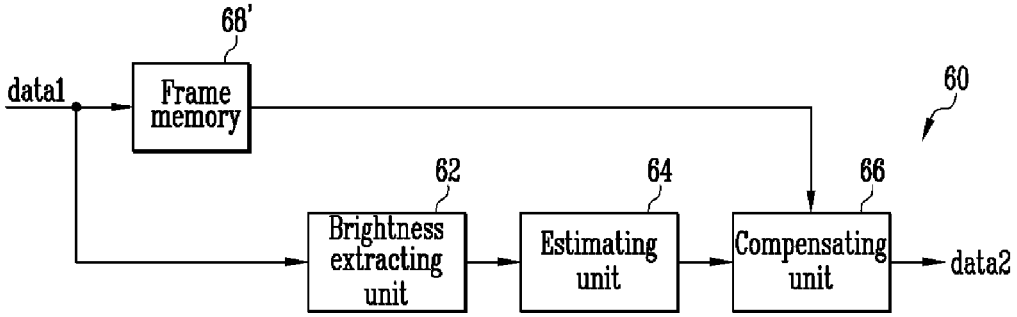
FIG. 6 is a view illustrating a third embodiment of the data processing unit of FIG. 1.

FIG. 6 is a view illustrating a third embodiment of the data processing unit of FIG. 1. In FIG. 6, the same elements as the elements of FIG. 2 are denoted by the same reference numerals and detailed description thereof will be omitted.

Referring to FIG. 6, the data processing unit 60 according to the third embodiment of the present invention further includes a frame memory 68' for storing the first data data1 and for supplying the stored first data data1 to the compensating unit 66. When the frame memory 68' is added, the brightness extracting unit 62 extracts the brightness value Y from the first data data1 supplied from the outside in real time and the compensating unit 66 generates the second data data2 using the first data data1 stored in the frame memory 68'. That is, according to the third embodiment of the present invention, the frame memory 68' stores the first data data1 in the operation time of the brightness extracting unit 62 and the estimating unit 64.

Figure 7:
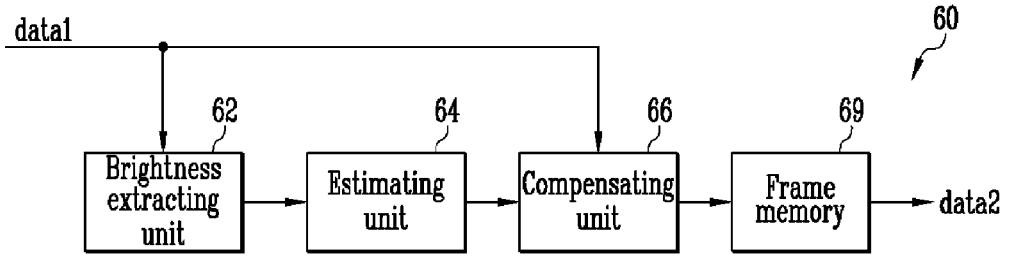
FIG. 7 is a view illustrating a fourth embodiment of the data processing unit of FIG. 1.

FIG. 7 is a view illustrating a fourth embodiment of the data processing unit of FIG. 1. In FIG. 7, the same elements as the elements of FIG. 2 are denoted by the same reference numerals and detailed description thereof will be omitted.

Referring to FIG. 7, the data processing unit 60 according to the fourth embodiment of the present invention further includes a frame memory 69 for storing the second data data2 supplied from the compensating unit 66 in one frame to output the stored second data data2. In this case, the timing controller 50 may stably receive the second data data2.

While the present invention has been described in connection with certain embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display, comprising:

a plurality of pixels positioned at intersections of scan lines and data lines;

a data driver for generating data signals to be supplied to the data lines using second data; and a data processing unit for generating the second data whose bit value is changed in consideration of brightness distribution of first data items supplied from outside the data processing unit, wherein the data processing unit comprises:

a brightness extracting unit for extracting a brightness value from the first data items;

an estimating unit for generating a first calculated value that represents a ratio of low gray scales from the brightness value, a second calculated value that represents a ratio of high gray scales, and a compensating value including brightness distribution information; and a compensating unit for generating the second data using the first calculated value, the second calculated value, and the compensating value.

2. The organic light emitting display as claimed in claim 1, wherein the brightness extracting unit extracts the brightness value from each of the plurality of pixels.

3. The organic light emitting display as claimed in claim 1, wherein the estimating unit increases a first brightness value when the brightness value is no less than a first threshold value that represents a reference point of high gray scales, increases a third brightness value when the brightness value is no more than a second threshold value that represents a reference point of low gray scales, and increases a second brightness value when the brightness value is positioned between the first threshold value and the second threshold value and divides the first brightness value, the second brightness value, and the third brightness value by the number of pixels to generate a first brightness distribution value, a second brightness distribution value, and a third brightness distribution value.

4. The organic light emitting display as claimed in claim 3, wherein the estimating unit divides the third brightness distribution value by a value obtained by adding the first brightness distribution value and the second brightness distribution value to generate the first calculated value, and divides the first brightness distribution value by the second brightness distribution value to generate the second calculated value.

5. The organic light emitting display as claimed in claim 1, wherein the estimating unit compares the first calculated value with a plurality of different reference values to generate the compensating value.

6. The organic light emitting display as claimed in claim 1, wherein the compensating unit changes a bit of the first data items so that brightness is reduced to generate the second data when the first calculated value is larger than the second calculated value.

7. The organic light emitting display as claimed in claim 6, wherein the compensating unit generates the second data so that the brightness is reduced as the compensating value increases.

8. The organic light emitting display as claimed in claim 1, wherein the compensating unit changes the first data items so that brightness of low gray scales is increased and that brightness of high gray scales is reduced to generate the second data when the second calculated value is larger than the first calculated value.

9. The organic light emitting display as claimed in claim 8, wherein the compensating unit controls a brightness increase value of the low gray scales and a brightness reduction value of the high gray scales in inverse proportion to the compensating value.

10. The organic light emitting display as claimed in claim 1, further comprising a frame memory for storing the first data items and for supplying the stored first data items to the brightness extracting unit and the compensating unit.

11. The organic light emitting display as claimed in claim 1, further comprising a frame memory for storing the first data items and for supplying the stored first data items to the compensating unit.

12. The organic light emitting display as claimed in claim 1, further comprising a frame memory coupled to the compensating unit to store the second data items and to supply the stored second data items.

13. A method of driving an organic light emitting display including a plurality of pixels, comprising:

extracting a brightness value from first data;

generating a first calculated value that represents a ratio of low gray scales from the brightness value;

generating a second calculated value that represents a ratio of high gray scales from the brightness value;

generating a compensating value including brightness distribution information using the first calculated value; and changing a bit of first data supplied from outside the organic light emitting display using the first calculated value, the second calculated value, and the compensating value, to generate second data.

14. The method as claimed in claim 13, wherein the brightness value is extracted from the plurality of pixels.

15. The method as claimed in claim 13, further comprising:

increasing a first brightness value when the brightness value is no less than a first threshold value that represents a reference point of high gray scales;

increasing a third brightness value when the brightness value is no more than a second threshold value that represents a reference point of low gray scales;

increasing a second brightness value when the brightness value is between the first threshold value and the second threshold value; and dividing each of the first brightness value, the second brightness value, and the third brightness value by the number of pixels to respectively generate a first brightness distribution value, a second brightness distribution value, and a third brightness distribution value.

16. The method as claimed in claim 15, wherein the first calculated value is generated by dividing the third brightness distribution value by a value obtained by adding the first brightness distribution value and the second brightness distribution value.

17. The method as claimed in claim 15, wherein the second calculated value is generated by dividing the first brightness distribution value by the second brightness distribution value.

18. The method as claimed in claim 15, wherein the compensating value is generated by comparing the first calculated value with a plurality of different reference values.

19. The method as claimed in claim 13, wherein second data is generated by changing the bit of the first data so that brightness is reduced when the first calculated value is larger than the second calculated value.

20. The method as claimed in claim 19, wherein the second data is generated so that the brightness is reduced as the compensating value increases.

21. The method as claimed in claim 13, wherein the second data is generated so that brightness of low gray scales is increased and that brightness of high gray scales is reduced when the second calculated value is larger than the first calculated value.

22. The method as claimed in claim 21, wherein the second data is generated so that the brightness increase value of the low gray scales and the brightness reduction value of the high gray scales are in inverse proportion to the compensating value.

* * * * *